US005611229A

United States Patent [19]

Chadbourne et al.

[11] Patent Number: 5,611,229

[45] Date of Patent: Mar. 18, 1997

[54] ABUSE INDICATOR FOR EXCESSIVE HANDLE LOADING

[75] Inventors: Christopher G. Chadbourne, Nashua; Gary E. Schrader, Londonderry; Mark W. Blake, Wilton, all of N.H.

[73] Assignee: Burndy Corporation, Norwalk, Conn.

[21] Appl. No.: 387,456

[22] Filed: Feb. 13, 1995

[51] Int. Cl.[6] ..... H01R 43/042

[52] U.S. Cl. ..... 72/31.01; 72/409.12; 72/409.14; 81/427.5; 29/751

[58] Field of Search ..... 72/31.01, 31.1, 72/31.11, 409.01, 409.12, 409.14; 81/427.5, 479; 29/751

[56] References Cited

U.S. PATENT DOCUMENTS

| | | | |
|---|---|---|---|
| 1,910,839 | 5/1933 | Jensen | 72/409.12 |
| 3,120,772 | 1/1961 | Mixon, Jr. . | |
| 3,330,148 | 7/1967 | Hornung . | |
| 3,504,417 | 4/1970 | Filia | 72/409.14 |
| 4,381,661 | 5/1983 | Wiener | 72/409.12 |
| 4,467,598 | 8/1984 | Wells | 59/78 |
| 4,640,117 | 2/1987 | Anderson et al. | 72/410 |
| 5,168,743 | 12/1992 | Schrader et al. | 72/410 |
| 5,279,140 | 1/1994 | Blake et al. | 72/410 |

*Primary Examiner*—Daniel C. Crane
*Attorney, Agent, or Firm*—Hoffman, Wasson & Gitler, P.C.

[57] ABSTRACT

A crimping tool comprises a pair of handles, cooperating metal jaws, dies, and/or die nests positioned at one end of the handles, and in alignment with each other, to receive a connector therebetween. Strengthening metal links and bolts secure the cooperating dies to the handles, so that the operation of the handles forces the jaws toward each other to impart radially directed crimping force to the connector. The handles are molded of an impact resistant plastic, and a unique, hourglass-shaped indicator link, formed of aluminum, a composite plastic, or other another material, may be incorporated into each handle near its upper end. A larger hole may be defined near the upper, exposed end of each link, while a smaller hole is defined near the lower end of each link, which is encased in plastic. When the crimping tool is subjected to abusive treatment, such as when the tool handle is used as a pry-bar, the encased end of each link elongates and/or collapses, providing an accurate visual indication through apertures provided in handles and of improper, abusive handling of the crimping tool. Furthermore, the indicator links are operatively associated with the mechanical linkage joining the handles to the working head of the tool, so that the indicator links enhance the strength of the tool, particularly under tensile loading.

8 Claims, 2 Drawing Sheets

ABUSE INDICATOR FOR EXCESSIVE HANDLE LOADING

FIELD OF THE INVENTION

The present invention relates generally to indicators for indicating that a tool has been subjected to abusive treatment. More specifically, the present invention relates to a simple indicator link, shaped as an hourglass, that (1) provides immediate verification of tool abuse, and (2) increases resistance to tensile loading.

BACKGROUND OF THE INVENTION

Crimping tools for securing metal connectors to electrical conductors are well known and widely used. Known crimping tools generally include a first handle, a second handle, a mechanical linkage located intermediate the first and second handles to allow pivotal movement therebetween, and an attached working head comprised of two pivotally connected jaws. A first die, or die groove, is defined in one jaw, and a second die, or die groove, is defined in the second jaw in alignment with the first die. When the handles are opened, or spread apart, the mechanical linkage forces the jaws apart so that a connector can be inserted into an aperture defined between the dies, or die grooves.

After a conductor is introduced into the connector, and is properly aligned therewith, the ends of the handles remote from the dies are manually operated. The crimping pressure exerted by the dies, or die grooves, upon the connector radially indents same, and mechanically, and electrically, joins the connector to the conductor. At the completion of each crimping operation, the handles are swung apart, to an open position, so that the connector and conductor can be removed from the dies, or die grooves.

During crimping operations, a connector is placed within the crimping dies, and the operator, or installer, closes the handle inwardly. When the crimping operation occurs, compressive loads are developed at the mechanical linkage interface with the tool handles. The tool handles are sturdy enough to withstand such compressive loads, and a properly crimped connector results upon full closure of the handles.

Representative crimping tools are shown in U.S. Pat. No. 3,330,148, granted Jul. 11, 1967 to Elmer H. Hornung, and U.S. Pat. No. 3,120,772, granted Feb. 11, 1964, to James L. Mixon.

Additionally, the Hornung patent recognized that the components of the crimping tool must be manufactured and assembled within close tolerances, so that the tool can perform satisfactorily for extended periods of time, under field conditions. To achieve these desirable goals, Hornung provided an adjusting screw (43) that manipulated the position of toggle arm (37) that joined the handles, and dies, together. Gage notch (45) and gage edge (44) provided a visual indication to the operator of the tool that the tool was in proper alignment. When misalignment was detected, adjusting screw (43) was manipulated to adjust linkage (37) so that gage indicators (44, 45) were brought into the desired relationship.

Another crimping tool that relies upon a visual indicator to alert the operator to diminution of effectiveness of the tool is disclosed in U.S. Pat. No. 5,279,140, granted to Mark W. Blake et al, and assigned to Burndy Corp., the assignee of the present invention. U.S. Pat. No. 5,279,140 discloses a crimping tool (10) including a working head (12) and a pair of handles (14). The working head is made of metal, and comprises pivotally connected jaws (16, 17) joined by straps, or plates (18), on opposite sides thereof. Die cavities (20, 21) are defined between the cooperating surfaces of the jaws.

The handles are operably connected to each other by strengthening links (23) and a bolt (26). The handles are made of an impact resistant polymer plastic. Cooperating markings, or indicia (54, 58), are defined on strengthening link (23) and on one handle. When excessive misalignment occurs, as reflected by indicia (54, 58) visible to the operator, the handles may be replaced, and proper alignment re-established.

Furthermore, as noted previously, the mechanical linkages of known crimping tools are subjected to compressive loading during crimping operations. Sturdy metal handles, or polymer composite materials, as disclosed in U.S. Pat. No. 5,279,140, are designed to accept such loads so that the tools function satisfactorily.

However, when the handles of known crimping tools are pivoted outwardly to the end of their opening stroke, the possibility of excessive loading exits. If impact loads, or large static loads, are applied to the tool in the opened orientation, such as may occur when the tool is dropped from a considerable height, significant tensile loads are created at the mechanical linkage interface. The tool handles are considerably stronger in compression, than in tension, and the significant tensile loads adversely influence the structural integrity and operational characteristics of the crimping tool.

SUMMARY OF THE INVENTION

Thus, recognizing the shortcomings of known crimping tools, the present invention provides a thin indicator link, that strengthens crimping tools to resist tensile loading. Such link, which may be formed of aluminum, a similar extensible metal, or a high strength polymer composite, is operatively associated with the mechanical linkage of the crimping tool.

The indicator link, which possesses an hourglass shape when seen in a top plan view, is partially encased within the composite polymer plastic handle of the crimping tool. The exposed end of the hourglass-shaped link, is located at the upper end of one handle. A pair of links are used for each tool, one link being partially encased within each handle.

A first viewing aperture is formed on the front face of the tool, and a second viewing aperture is formed on the rear face of the tool. The apertures allow visual inspection of the encased portions of each indicator link.

The indicator links serve a dual purpose. First, the indicator links strengthen the crimping tool employing same, particularly under tensile loading, such as may occur when the tool is dropped under normal circumstances. Second, the indicator links function as valid indicators that the crimping tool has been subjected to purposeful, destructive acts, such as occur when the handles of the tool are used as levers to pry structures apart. These acts impose excessive tensile loading upon the indicator links, and the mechanical linkage interface, and distort and/or elongate the metal link(s). Such distortion is visible through the viewing apertures.

Consequently, when the tool manufacturer provides a warranty to the tool purchaser to replace and/or repair a crimping tool that fails to function properly under normal operating conditions, the manufacturer can now distinguish between normal tool failure modes and purposeful destructive acts, and honor the warranty in the appropriate fashion.

For example, under a manufacturer's warranty, the former course of conduct might be forgiven, and a replacement tool would be provided in accordance with the terms of the warranty. The latter course of conduct would nullify the warranty, and excuse the manufacturer from repairing, or replacing, the tool, without charge, since it can now be irrefutably determined that the cause of premature failure was the improper use and/or destructive acts of the tool user.

Other advantages and benefits that flow from the present invention will become apparent to the skilled artisan, when the appended drawings are construed in harmony with the detailed specification.

DESCRIPTION OF THE PREFERRED EMBODIMENT

Figure 1:
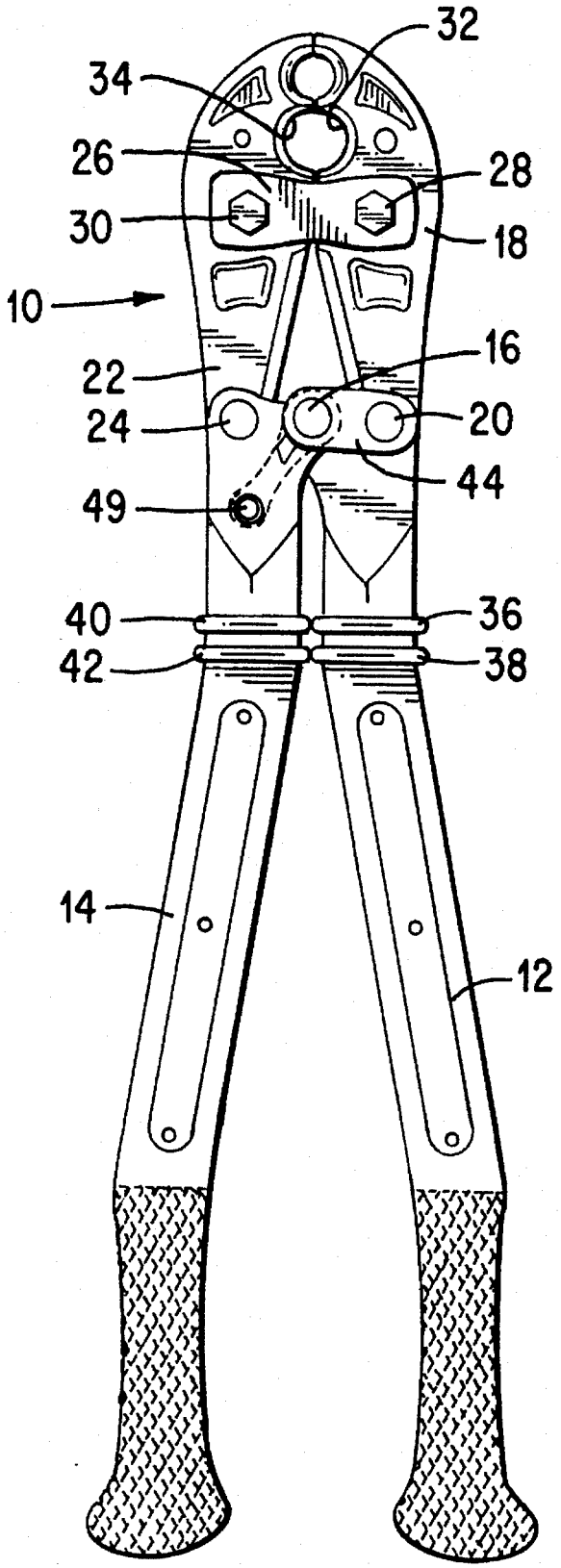
FIG. 1 is a front elevational view of a crimping tool utilizing the indicator link constructed in accordance with the principles of the present invention.

FIG. 1 depicts a crimping tool 10 constructed in accordance with the principles of the present invention. Tool 10 comprises a first handle 12, a second handle 14, and a high strength, steel pin 16, which passes through aligned apertures (not shown) in each handle, to secure the handles together. The lower end of first metal jaw 18 fits into a slot (not shown) defined at the upper end of handle 12, and is secured therein by bolt 20. The lower end of second metal jaw 22 fits into a slot (not shown) defined at the upper end of handle 14, and is secured therein by bolt 24.

Jaw link 26 and a second jaw link (not shown) joins jaws 18, 22 together and strengthens the tool. Fastener 28 secures one end of jaw link 26 to jaw 18, while fastener 30 secures the other end of the jaw link to jaw 22. Crimping grooves 32, 34 are defined between jaws 18, 22 at the upper end of the tool. Annular butt stops 36, 37; 40, 42 on handles 12, 14 define the closed position of tool 10.

A first, sturdy link 44 extends between pin 16 and bolt 20 for jaw 18, and a second sturdy link (not shown) extends between pin 16 and bolt 24 for jaw 22. The second link is situated on the opposite, bottom surface of tool 10.

The jaws of tool 10 are formed of steel, and preferably, may be plated. The links, pivot pin, and jaw links, may also be formed of nickel plated steel, to enhance corrosion resistance. Handles 12 and 14 may be made of a high strength polymer composite, and the handles may be ergonomically design for a slip-free grip. The foregoing tool is described in U.S. Pat. No. 5,279,140, and is sold and distributed by the present assignee, Burndy Corporation, under the trademark MD7 SERIES POSI-PRESS HYTOOL™.

The unique indicator link 48 is shown in FIGS. 1–5. Indicator link 48 consists of a thin layer of aluminum, or another extensible material; alternatively, link 48 may be formed of a high strength polymer composite. A first, and larger, aperture 50 is formed proximate one end of the link, and a second, smaller aperture 52 is formed proximate the opposite end of the link. Pin 16 passes through aperture 50 of link 48, and aperture 52 is used only to position indicator link 48. During fabrication of the handle/indicator assembly, the mid-section and smaller, or lower end, of the hourglass-shaped indicator link 48 are molded into, or otherwise retained in fixed position, within the plastic composite that is used to form handles 12, 14 of tool 10. The larger, or upper end, of link 48 projects beyond wall 51 and rests upon knuckle 53.

Indicator link 48, when viewed in plan elevation, is hourglass-shaped. The larger radius, which is exposed, serves as the stronger end of the link and receives pin 16. The central section and the smaller radius end portion of the link are encased in the polymer composite plastic during fabrication of handles 12, 14.

Figure 3:
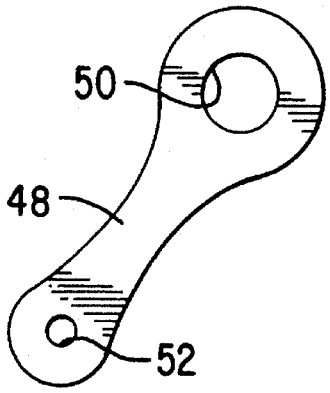
FIG. 3 is a plan view of the indicator link of FIGS. 1 and 2, such link being shown in its normal condition.
Figure 4:
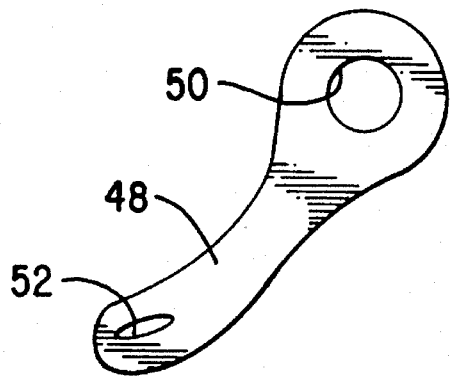
FIG. 4 is a plan view of the indicator link of FIGS. 1 and 2, such link being shown in its overstressed condition.

FIG. 3 shows indicator link 48 in its normal condition, connoting that the tool has not been subjected to abusive handling. In contrast thereto, FIG. 4 shows link 48 after one of the handles of the tool has been used as a prybar or other such device to impart a higher leverage force than is required during normal operation. The excessive tensile force exerted upon handles 12 or 14 causes the link to elongate at the small radius, i.e., in the vicinity of aperture 52. The strongest portion of indicator link 48 remains fixed about pin 16, and is undistorted. The distortion of indicator link 48 is shown in FIG. 4, and is readily detected by service personnel at the factory, or in the field, through an aperture 49 provided in handles 12 and 14 when tool 10 is returned for service or replacement.

Indicator link 48 discriminates between failures that are the result of accidentally imposed violent shock loading, such as occur when the tool is dropped, or when the handles are popped open, and deliberate abuse. Since most of link 48 is encased within the plastic handles of tool 10, the plastic material, in combination with the indicator link 48, absorbs violent shock loading associated with normal use and accidental misuse of the tool.

Figure 2:
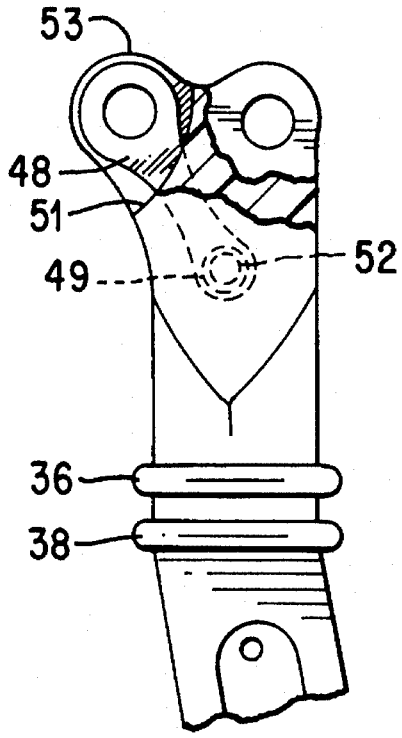
FIG. 2 is a fragmentary plan view of the upper end of one of the handles of the crimping tool shown in FIG. 1, showing the indicator link in relationship to such handle.

Whereas one surface of the larger radius of indicator link 48 is visible on the interior surface of handle 12 in FIG. 2, a second indicator link 48 will be used on the interior surface of handle 14. One end of each indicator link 48 is secured to pin 16, while the other end of each indicator link 48 is retained in fixed position by its encasement within the polymer composite plastic.

Figure 5:
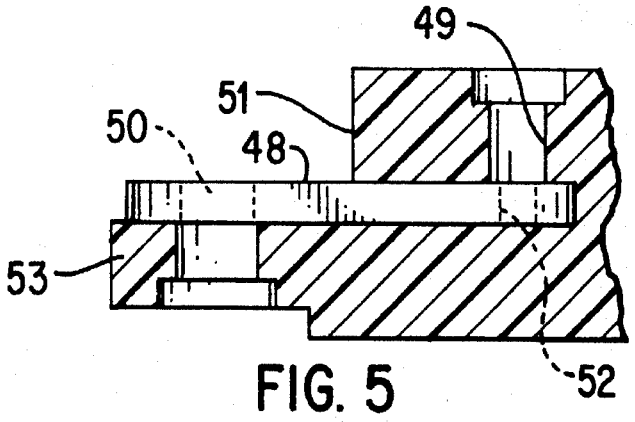
FIG. 5 is a fragmentary side elevational view, on an enlarged scale, of the indicator link and the upper end of one handle of the crimping tool.

Aperture 49 on handle 12 is visible in FIG. 2. Such aperture enables one to observe the end portion of indicator link 48, and to detect the elongation of such link that is caused by excessive tensile forces being applied to the mechanical linkage between handles 12 and 14. The uniform thickness of indicator link 48 is shown in FIG. 5; the thickness may be only a minute fraction of an inch, and may approach that of aluminum foil. The spatial relationship of indicator link 48 to shoulder 51 and knuckle 53 of handle 12 is also shown in FIG. 5.

The unique indicator assembly is applicable to diverse other tools, and revisions, modifications, and refinements will occur to the artisan from the detailed description of the present invention. For example, metals and/or metal alloys other than aluminum, in addition to other suitable materials, might be used to fabricate the indicator links. While the indicator links may possess uniform thickness, different portions of the link may be formed with different thicknesses. Whereas, two indicator links 48 are preferred, one visible at the front surface the tool, and the other visible at the rear surface, under some circumstances, one indicator link may prove to be sufficient. Thus, the appended claims should be broadly construed in a manner consistent with the spirit and scope of the present invention, and should not be limited to their literal terms.

We claim:

1. A crimping tool comprising:

a) a pair of handles, b) a mechanical linkage located intermediate said handles and connecting same to allow pivotal movement therebetween, c) a working head connected at one end to said mechanical linkage, d) said working head consisting of a pair of pivotally connected jaws, e) a first die formed in one of said jaws and a second die formed in the other one of said jaws, f) said handles, when pivoted away from one another, causing said mechanical linkage to force said jaws apart, and g) said handles, when pivoted toward one another, causing said mechanical linkage to bring said jaws together so that said dies are in alignment and are subjected to compressive forces, h) said handles being formed of a composite polymer plastic, i) the invention being characterized by an indicator link encased within at least one of said plastic handles, j) said indicator link being formed of an extensible material that will elongate in response to excessive tensile forces being applied to said handle.

2. A crimping tool as defined in claim 1 wherein said indicator link has an hourglass shape, and said link is oriented along the longitudinal axis of the handle.

3. A crimping tool as defined in claim 1 wherein said indicator link is formed of a thin layer of an extensible metal.

4. A crimping tool as defined in claim 3 wherein said extensible metal is aluminum.

5. A crimping tool as defined in claim 1 wherein said indicator link is formed of a thin layer of a high strength polymer composite.

6. A crimping tool as defined in claim 3 wherein said indicator link is formed with a uniform thickness.

7. A crimping tool as defined in claim 1 wherein a first indicator link is located at the end of the first handle in proximity to said mechanical linkage, and a second indicator link is located at the end of the second handle in proximity to said mechanical linkage, said first and second indicator links being connected to said mechanical linkage to strengthen same against tensile forces.

8. A crimping tool as defined in claim 1 wherein at least one handle has a viewing aperture near its upper end, said aperture enabling one to observe a portion of said indicator link and detect elongation thereof.

* * * * *